United States Patent [19]

Skrobisch

[11] 4,393,362

[45] Jul. 12, 1983

[54] ELECTROMAGNETIC INDICATOR HAVING A ROTOR DISPOSABLE IN DISCRETE POSITIONS

[75] Inventor: Alfred Skrobisch, Commack, N.Y.

[73] Assignee: The Staver Company, Inc., Bay Shore, N.Y.

[21] Appl. No.: 340,309

[22] Filed: Jan. 18, 1982

[51] Int. Cl.[3] ..... H01F 7/08; H01F 7/14

[52] U.S. Cl. ..... 335/272; 340/815.26

[58] Field of Search ..... 335/272; 340/815.26

[56] References Cited

U.S. PATENT DOCUMENTS 3,158,796 11/1964 Musgrave ..... 335/272

4,128,825 12/1978 Madsen ..... 335/272

FOREIGN PATENT DOCUMENTS 1492312 8/1967 France ..... 340/815.26

*Primary Examiner*—Harold Broome

*Attorney, Agent, or Firm*—Edward H. Loveman

[57] ABSTRACT

An electromagnetic indicator has a stator carrying a stationary reversibly magnetizable core, and a rotor including a display disk and rotary cylindrical magnet. The magnet is permanently magnetized with two poles each angularly spaced apart less than 180° at one side of a diameter of the magnet which also passes through the radially located core. Stop elements carried by the stator and core are engaged in each stopping position of the rotor when one of the magnet poles is attracted to, but held spaced from the magnetized core. The poles can be located to effect a turning range of the rotor from 120° to 250°.

10 Claims, 14 Drawing Figures

ELECTROMAGNETIC INDICATOR HAVING A ROTOR DISPOSABLE IN DISCRETE POSITIONS

This invention concerns an electromagnetic indicator and more particularly concerns an electromagnetic indicator device having a rotor disposable in predetermined discrete display positions and more specifically concerns an electromagnetic indicator having a bipolar rotary magnet with each pole offset on the same side of a diameter and spaced apart less than 180°.

It has been known heretofore to provide an electromagnetic indicator employing a rotor carrying a display disk which is selectively disposable in either of two positions spaced 180° apart. Such an indicator is described in prior U.S. Pat. No. 4,156,872, which issued May 29, 1979.

Such prior indicators have several disadvantages and limitations. First, the rotor turns up to 180° to either one of the two display positions determined by the locations of the poles of the rotary magnets, which poles are spaced apart 180°. Secondly, for 180° rotation, the rotor is free swinging at either terminal of travel because no rotational torque exists between the rotor and the core they are exactly aligned. Thus, the rotor responds to any mechanical shock by oscillating or bouncing which is visually undesirable.

The present invention is directed at overcoming the above and other disadvantages and shortcomings of prior electromagnetic indicators of the rotary type described, and at providing an electromagnetic indicator which has greater versatility, utility, and capability for a greater range of applications.

The present indicator employs a single straight stator core or pole piece made of a permanent magnetic material wound with a coil or wire. Electric current passed through the coil magnetizes the core with a first polarity and reversal of the current direction reverses the magnetic polarity of the core. The core is elongated and disposed radially to and adjacent the periphery of a generally cylindrical permanent magnet carrying and driving a display disk. To the extent described the stator and rotor structure of the indicator is conventional. Now according to the invention, the disk-driving cylindrical magnet of the rotor has two poles which are located, not at opposite ends of a vertical diameter of the magnet as in the prior art, but at angles to that diameter, both N and S poles being located on the same side of a diameter of the magnet that also passes through the elongated axis of the radially located core. The stator of the indicator is provided with stops or abutments which are contacted by a stop element carried by the rotor. Neither pole of the disk-driving rotary magnet is ever allowed to align itself with the pole of the magnetized stator core. At each display position the rotor stop element contacts a stator abutment. This insures continuous attraction of a rotary magnet pole to the stator core at each stopped position of the display disk. The rotor is held positively at each discrete stopped position and cannot flutter, oscillate or bounce. The preset angles between either the N or the S pole of the rotor magnet and the abovementined diameter may range from 10° to 45° so that the disk-driving magnet can turn any amount up to about 250°. The rotor can turn 180°, or less than 180° or more than 180° depending on the location of the poles of the rotary magnet and the rotor stop element. The rotor can reverse rotation by the same angular amount or less by reversing pole polarity of the stator magnet. At each extreme position of rotation there will always be enough of an angle between the stator core and nearest pole of the rotary magnet to cause pressure of the rotor's stop element against a stator abutment, due to magnetic attraction between poles of the core and rotary magnet.

When the stator core polarity is made the same as that of the pole of the rotary magnet nearest the stator core, the rotary magnet is repulsed and the rotor turns away from its first discrete stop position until the opposite pole of the rotary magnert is drawn toward the stator core where the rotor is halted and held by contact betwen the rotor stop and stator abutment at the second discrete position of the rotor. Reversing the polarity of the stator core reverses the direction of rotor rotation and the rotor returns to its first stop position. The rotor at each stop position is halted and stays substantially without bounce or oscillation in contrast to the bounce and oscillation encountered with prior free swinging rotors in electromagnetic indicators.

It is therefore a principal object of the present invention to provide an electromagnetic indicator device having a rotary magnet whose N and S poles are angularly disposed on the same side of a diameter of the magnet.

A further object of the present invention is to provide an indicator device as described wherein the poles are angularly disposed on one side of a vertical diameter of the magnet, and the rotary magnet is limited to rotate between two discrete stop positions spaced up to 250° apart.

Another object of the present invention is to provide an indicator device as described providing stop means carried by the rotor and other stop means on the stator arranged so that both stop means engage each other at each discrete stop position of the rotor.

A further object of the present invention is to provide an indicator device as described wherein the rotor may carry a two-sided display member, with each side displayed at a different discrete stop position of the rotor.

These and other objects and many of the attendant advantages of this invention will be readily appreciated as the same becomes better understood by reference to the following detailed description when considered in connection with the accompanying drawings in which:

FIG. 1 is a side elevational view of an electromagnetic indicating device embodying the present invention;

FIGS. 2 and 3 are right and left end elevational views respectively taken along lines 2—2 and 3—3 of FIG. 1;

Figure 1:
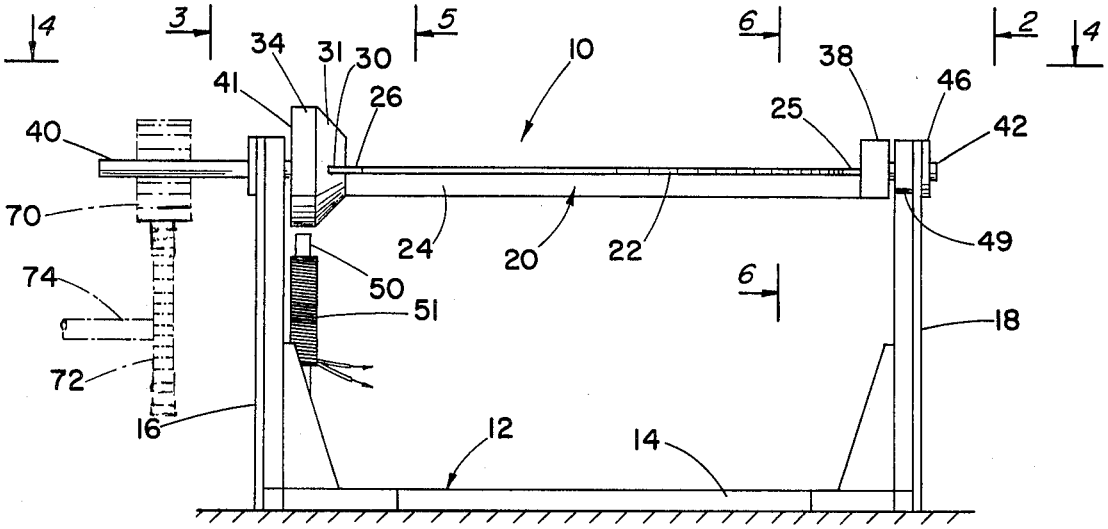

Referring now to the drawings wherein like reference characters designate like or corresponding parts throughout, there is illustrated in FIGS. 1 to 6, an electromagnetic indicator device generally designated as reference numeral 10 having a rectangular U-shaped stand 12 provided with a horizontal base 14 and upright supports 16 and 18 at opposite ends. The stand serves as the stator of the device and rotatably supports a rotor 20.

Figure 4:
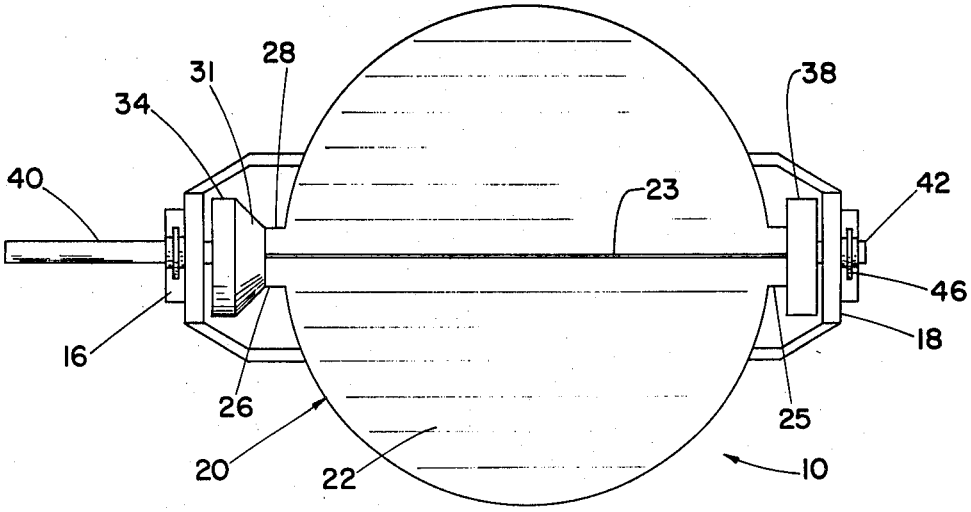
FIG. 4 is a reduced plan view taken along line 4—4 of FIG. 1.

The rotor 20 comprises a substantially circular disk 22 which is symmetrical on opposite sides of a diametral line 23; see FIG. 4. The disk 22 may carry certain indicia on one or both sides which are selectively displayed when the rotor 20 is turned electromagnetically and halted and held in one of its discrete stop positions.

The disk 22 may have an integral diametral rib 24 which extends fully across and centrally of the disk 22 at one side and extends outwardly beyond the disk at diametrically opposite points to define pedestals of two T-shaped trunnions 25 and 26. A laterally extending tab 28 of each of the trunnions 25 and 26 is an integral diametral extension of the disk 22.

Figure 2:
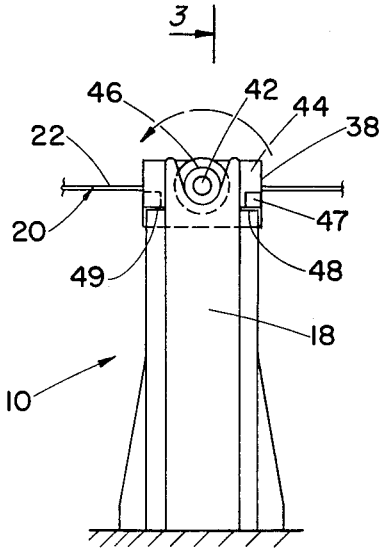
FIG. 2A is a fragmentary end elevational view similar to a portion of FIG. 2, showing the rotor turned 180° from the position of FIG. 2.
Figure 5:
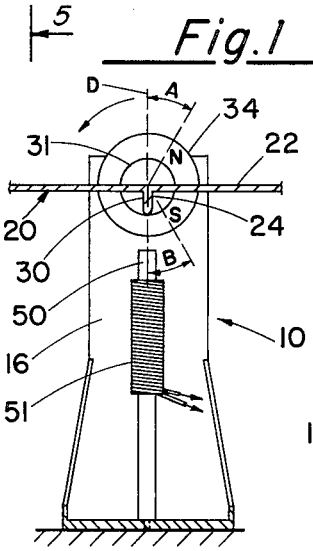
FIG. 5 is a vertical cross sectional view taken along line 5—5 of FIG. 1.
Figure 3:
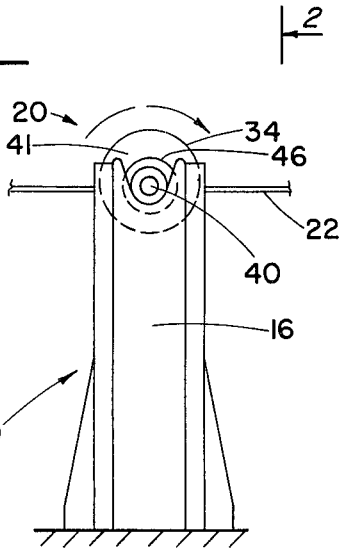
Figure 7:
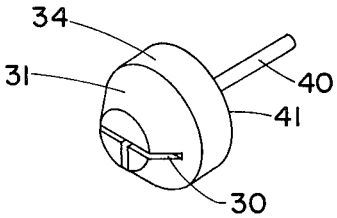
FIG. 7 is a perspective view of a rotary magnet used in the rotor.
Figure 8:
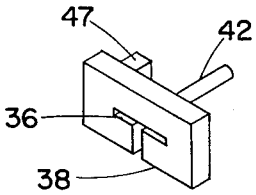
FIG. 8 is a perspective view of a journal block used in the rotor.
Figure 9:
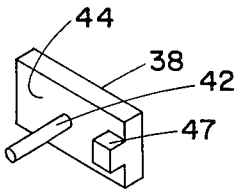
FIG. 9 is a perspective view of the journal block shown reversed 180° from the position of FIG. 8.
Figure 10:
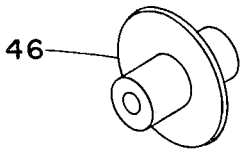
FIG. 10 is a perspective view of a bearing member used in the indicator device to support one end of the rotor.
Figure 6:
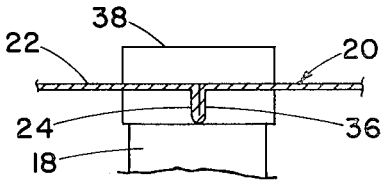
FIG. 6 is a fragmentary cross sectional view taken along line 6—6 of FIG. 1.
Figure 2A:
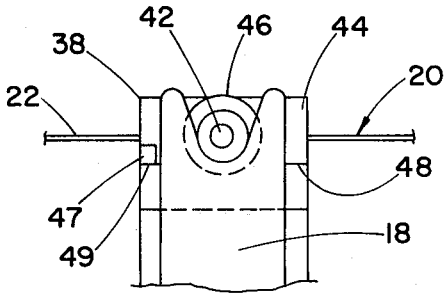

One trunnin 26 is inserted and frictionally engaged in a T-shaped slot 30 formed in a frustoconical axial extension 31 of a cylindrical magnet 34; see FIGS. 1, 5, and 7. The other trunnion 25 is inserted and frictionally engaged in a T-shaped slot 36 formed in one side of a trunnion and stop block 38; see FIGS. 6, 8, and 9. The magnet 34 may have an axial shaft 40 extending outwardly of an outer side 41 of the magnet 34 which is opposite from the slot 30. The block 38 may have a shaft 42 extending outwardly of an outer side 44 of the block 38 which is opposite from the slot 36. The shafts 40 and 42 may be journaled in bearings 46 secured to outersides of the supports 16 and 18; see FIGS. 1, 2, and 10. A lug 47 extends outwardly of the side 44 of the block 38, and serves as a stop member to engage on shoulders or abutments 48 and 49 spaced apart at opposite lateral sides of the upright stand member 18, as best shown in FIGS. 1, 2, and 2A. The lug 47 limits angular rotation of the rotor 20 between discrete stop positions spaced predetermined angular positions apart. The abutments 48 and 49 can be located at different heights to determine and fix the limits of angular rotation of the rotor 20 in any desired range. In the position shown in FIGS. 2 and 2A the rotor is limited to 180° of rotation. Lowering either or both of the abutments 48 or 49 will increase the angle of rotation beyond 180°. Raising either or both abutments 48, 49 will decrease the angle of rotation below 180°.

An axially upright straight, cylindrical, permanent magnetic core or pole piece 50 is mounted at one end of the base 14 near upright support 16. On the core 50 is wound a wire coil 51 which may be energized by a voltage applied to its terminals to establish a N or S pole at the end of the core 50 adjacent to the periphery of the magnet 34. Reversing the polarity of voltage and direction of current flow in the coil reverses the magnetic polarity of the core 50.

The magnet 34 is magnetized permanently at spaced points N and S spaced at predetermined angles A and B from a diameter D of the magnet; see FIG. 5. If the angle A and angle B are each 15° from diameter D, and if the abutments 48 and 49 are properly located with respect to the stop lug 47, the display disk 22 forming part of the rotor 20 will be limited to a 180° range of rotation from the position shown in FIGS. 1–6 and 11 to the reversed position shown in FIGS. 2A and 12.

Figure 11:
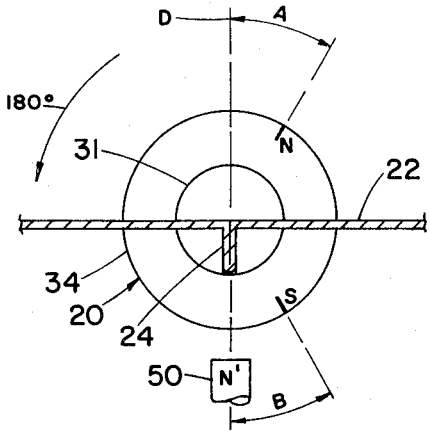
FIG. 11 is a diagram of the rotor showing it at one stop position.
Figure 12:
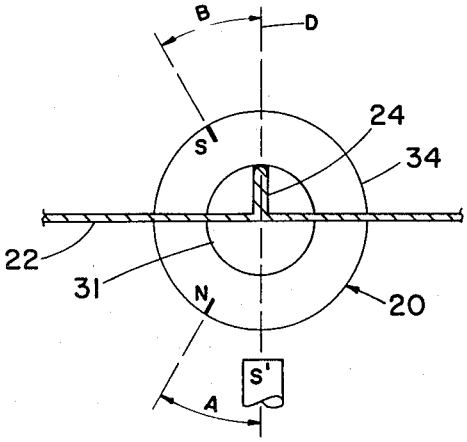
FIG. 12 is a diagram of the rotor similar to FIG. 11, showing the rotor at a second stop position rotated 180° from that of FIG. 11.

In the first position of FIG. 11, the magnetic pole N′ of the core 50 attracts the adjacent rotor pole S which is spaced B° from the pole N′ and cannot align itself with pole N′ since the stop lug 47 is in contact with the abutment 48 as shown in FIG. 2. When the polarity of the core is reversed to polarity S′ as shown in FIGS. 12 the rotor pole S is repulsed and the rotor pole N is attracted. The rotor 20 turns and stops at the position of FIGS. 2A and 12 where the rotor pole N is disposed at angle A to the stator pole S′ where the lug 47 contacts the abutment 49. It will be noted that the rotor turns in each direction and stops without substantial bouncing or oscillation because of the positive attraction between the poles N′-S and S′-N.

Figure 13:
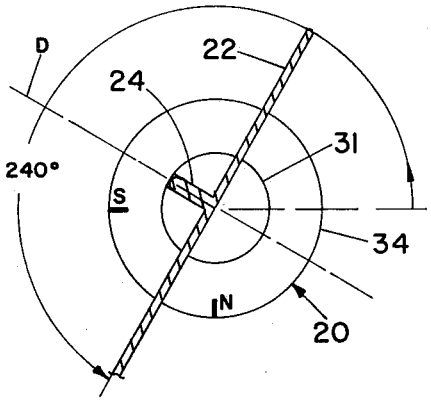
FIG. 13 is a diagram of the rotor showing it at an alternate stop position rotated 240° from that of FIG. 11.

FIG. 13 shows how the rotor 20 may turn more than 180°, for example about 240°. This is accomplished by magnetizing the rotor pole S about 45° from the diameter D and magnetizing the rotor pole N about 45° from the diameter D both rotor poles being on the same side of the diameter D. By properly locating the stop abutments 48 and 49 and properly positioning stop lug 47 so that, for example, each of the rotor poles is stopped 10° before core 50, the rotor 20 can be rotated through an angle of 250° with discrete stopping and holding at each extreme of rotation between the positions shown in FIG. 11 and the position in FIG. 13.

A further practical application for a rotor capable of turning more than 180° is illustrated in FIG. 1. Here a gear 70 is shown by dotted lines mounted on the shaft 40. The gear 70 meshes with another gear 72 of different size, for example a larger diameter gear journaled on a shaft 74. By this arrangement, a larger torque can be applied to the shaft 74 carrying the gear 72 than is produced by the shaft 40 driving the gear 70. The shaft 74 can be used as a power takeoff member for any appropriate use.

It should be understood that the foregoing relates to only a limited number of preferred embodiments of the invention which have been by way of example only and that it is intended to cover all changes and modifications of the examples of the invention, herein chosen for the purpose of the disclosure, which do not constitute departures from the spirit and scope of the invention.

What is claimed is:

1. An indicator device having two stable positions comprising:

a stator having a stationary elongated reversable polarity permanent magnet core;

means for reversing polarity of said permanent magnet core;

a rotor carried by said stator and having a magnet disposed adjacent to said core, said rotor being turnable angularly on an axis perpendicular to said elongated core from one of said stable positions to the second of said stable positions upon reversing polarity of said permanent magnet core;

said magnet having two magnetic poles each of which is located on the same side of a diameter of said rotor which diameter passes through said elongated core at each of said stable positions so that reversing polarity of said core will produce reverse turning movements of said magnet; and stop means carried by said stator and rotor and arranged for selective engagement so that rotation of said rotor is stopped at one of said stable positions in its angular movement where both of said poles are spaced from said core with one of said poles closest to said core attracted magnetically to said core while said stop means prevent rotation and vibratory movements of said rotor.

2. An indicator device as defined in claim 1, wherein said magnet poles are angularly spaced from said diameter of said rotor so that an angular rotation of said rotor may be produced at any angle up to approximately 250°.

3. An indicator device as defined in claim 1, wherein said stop means comprises a lug carried by said rotor, and abutments formed on said stator and angularly spaced apart for selective contact by said lug, so that said rotor is limited to turn in a predetermined angular range.

4. An indicator device as defined in claim 1, further comprising gearing driven by said rotor to provide power takeoff means while said rotor is being angularly turned.

5. An indicator device as defined in claim 1, wherein said rotor further comprises display means arranged to display different sides thereof when said rotor is stopped at said points respectively.

6. An indicator device as defined in claim 5, wherein said display means is a flat disk and wherein said sides are opposite sides of said disk.

7. An indicator device as defined in claim 3, wherein said abutments are spaced apart 180°.

8. An indicator device as defined in claim 2, wherein said stop means comprises a lug carried by said rotor, and abutments formed on said stator and angularly spaced apart for selective contact by said lug, so that said rotor is limited to turn in a predetermined angular range.

9. An indicator device as defined in claim 2, wherein said rotor further comprises display means arranged to display different sides thereof when said rotor is stopped at said points respectively .

10. An indicator device as defined in claim 2, wherein said stop means are arranged to limit rotation of said rotor to 180°, said rotor further comprising a flat disk for selectively displaying a different side thereof in each of said two stable position of said rotor.

* * * * *